US006300025B1

(12) United States Patent
Haggquist et al.

(10) Patent No.: US 6,300,025 B1
(45) Date of Patent: Oct. 9, 2001

(54) PHOTOCONDUCTORS WITH POLYSILOXANE AND POLYVINYLBUTYRAL BLENDS

(75) Inventors: Gregory Walter Haggquist, Longmont; Scott Thomas Mosier, Boulder; Kasturi Rangan Srinivasan, Longmont, all of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/585,045

(22) Filed: Jun. 1, 2000

(51) Int. Cl.[7] ..... G03G 5/05
(52) U.S. Cl. ..... 430/56; 430/96; 430/59.5
(58) Field of Search ..... 430/59.5, 59.4, 430/96, 56

(56) References Cited

U.S. PATENT DOCUMENTS 4,752,549 * 6/1988 Otsuka et al. ..... 430/56
5,128,225 * 7/1992 Oda et al. ..... 430/59.4
5,420,268 * 5/1995 Desilets et al. ..... 540/141
6,033,816 3/2000 Luo et al. .

FOREIGN PATENT DOCUMENTS 2-168258-A * 6/1990 (JP) .
3-17658-A * 1/1991 (JP) .

OTHER PUBLICATIONS

Chemical Abstracts 115:146601 (1991).*
Alger, Mark S.M. Polymer Science Dictionary. London: Elsevier Applied Science. p. 439. (1989).*
English translation of JP 3–17658 (Jan. 1991).*

* cited by examiner

*Primary Examiner*—Christopher Rodee
(74) *Attorney, Agent, or Firm*—John A. Brady

(57) ABSTRACT

A photoconductor having a charge generation layer of pigment and a binder resin of a thorough mixture of polyvinylbutyral, a polysiloxane, and, preferably, a phenolic resin. An optimum formulation was Type IV oxotitanium phthalocyanine in a binder of, by weight 50 parts polyvinylbutyral, 45 parts poly(methyl-phenyl)siloxane, and 5 parts polyhydroxystyrene. This photoconductor provides excellent electrical properties and consistent, economical coating results.

38 Claims, No Drawings

PHOTOCONDUCTORS WITH POLYSILOXANE AND POLYVINYLBUTYRAL BLENDS

TECHNICAL FIELD

This invention relates to improved photoconductive elements for electrostatic imaging. More specifically, this invention pertains to charge generation polymeric binders which are blends of polymers to enhance electrical characteristics and manufacturing efficiencies.

BACKGROUND OF THE INVENTION

An organic photoconductor typically comprises an anodized layer or a barrier layer on a conductive substrate such as an aluminum drum, a charge generation layer (CGL) and a charge transport layer (CTL). The charge generation layer is made of a pigment dispersed in the binder layer. U.S. Pat. No. 6,033,816 to Luo et al. (patent '816) is illustrative of such photoconductors employing a blend of polymers as the CGL binder layer.

The use of polymer binder helps improve the dispersion stability and improve the adhesion of the CGL to the metal core. However, depending on the type of polymer binder being used, the sensitivity of the photoreceptor may be affected. Polymers typically used as binders of the CGL dispersions or solutions are polyvinylbutyrals, which may be blended with various resins such as phenoxy, epoxy resins, polycarbonates and polyacrylates. Such polymers may be inert to the electrical photographic properties. However, in some cases, the polymer may increase the sensitivity of the CGL (sensitivity being the extent of discharge of the charged electrical potential on a drum when exposed to a light source, typically a laser beam). The need to improve the sensitivity of a photoconductor is directly tied to the process speed of imaging with that photconductor. As speeds are increased and the laser optical power stays constant, less and less energy is delivered to the charged photoconductor.

With printers expected to perform at speeds in excess of 35 standard 8½ in.×11 in. pages-per-minute, it is necessary that the photoconductor charge and discharge at very short time intervals. The time frames required for such a 35 page-per-minute printer could relate to an exposed-to-develop time on the order of 50–80 ms. Hence, a growing need exists to identify systems that improve electrophotographic properties without compromising other properties such a adhesion and fatigue.

A second need is to obtain electrical uniformity of the photoconductor. The desire to have uniform print density across a printed image requires the photoconductor to have a low variance from end to end and around the drum. The uniformity of the electrical performance is tied to the uniformity of the coating and the homogeneity of the dispersion. Different polymer binders can help or be a detriment to the dispersion homogeneity.

Also, with long production runs and the need for stable pigment dispersions, if the dispersion changes properties so as not to support a full production run, the cost of each drum is increased. This is also true if the dispersion can not be stored between runs. Present dispersion systems do not have adequate shelf life or electrical uniformity to satisfy such objectives, leaving a need for a system which can deliver exceptional electrical properties, dispersion stability, and electrical uniformity.

DISCLOSURE OF THE INVENTION

A CGL binder resin of a thorough mixture of polyvinylbutyral (PVB) and a polysiloxane, specifically poly(methyl-phenyl)siloxane (PMPSi), poly(dimethyl-diphenyl)siloxane or polydimethylsiloxane, with a phthalocyanine pigment provides excellent electrical properties and consistent, economical coating results. Preferred embodiments also include a phenolic resin as a third resin in the binder mixture.

DESCRIPTION OF THE PREFERRED EMBODIMENTS

The substrate of the embodiments discussed below is an anodized, standard aluminum drum. Such a drum provides a conductive substrate with an outer surface of intermediate resistivity. Similarly, the CTL may be a standard blend comprising a binder resin such as polycarbonate and 25% to 40% by weight N,N'-diphenyl-N,N'-di(3-tolyl)-p-benzidine (TPD) or 30% to 40% by weight p-(diethylamino) bcnzaldehyde diphenylhydrazone (DEH) or in general an arylamine or a hydrazone, and mixtures thereof.

The following examples all employ the same polymers or resin when that material is employed in the example. The phenolic resin is polyhydroxystyrene (PHS). The following table gives the number average (Mn) and weight average (Mw) molecular weights in g/mol; the polydispersity; and the glass transition temperature (Tg) in degrees C. Of course differing molecular weights and polydispersity can be employed depending on the overall physical and other characteristics desired in accordance with this invention.

| Sample | Mn | Mw | Polydispersity | Tg |
|---|---|---|---|---|
| PVB | 100336 | 277194 | 2.76 | 90 |
| PHS | 630411 | 626 | 2.69 | 163 |
| PMPSiO | 1218 | 2099 | 1.72 | |
| PVB/PHS/PMPSiO/ solution | 1495 | 44020 | 29.44 | |
| PVB/PHS/PMPSiO film | 1889 | 41296 | 21.86 | 82 |

EXAMPLE 1

The foregoing drum is coated with a thorough mixture by weight of 27.5 parts polyvinylbutyral, 27.5 parts poly (methyl-phenyl)siloxane, and 45 parts Type IV oxotitanium phthalocyanine. The charge transport layer is then coated on this layer as the outer layer.

The polyvinylbutyral in this and the following embodiments is BX-55Z of Sekisui Chemical Co. As shown by structural formula in patent '816 polyvinylbutyral has a three carbon and two oxygen ring structure, with three of the carbons in the polymer backbone and the oxygens connected to the outer two of the three carbons, with the fourth carbon connected to the two oxygens and having a chain of three carbon, all other elements being hydrogen. Polyvinylbutyral also has ethylene alcohol groups and ethylene acetate groups.

The polysiloxanes of this invention may be and the polysiloxane of the following embodiments (which is Dow Corning 710 Fluid) are standard polysiloxanes of commercial purity. The backbone of polysiloxanes is alternating silicon and oxygen atoms. Each silicon atom in the chain has two substituents. Poly(methyl-phenyl)siloxane has one methyl group and one phenyl group on each silicon. Poly (dimethyl-diphenyl)siloxane has two methyl groups or two phenyl groups on each silicon in the chain, the number of dimethyl groups and diphenyl groups being about the same and the distribution being random. Polydimethylsiloxane has two methyl groups on each silicon in the chain.

The foregoing drum with CGL of equal parts of polyvinylbutyral and the polysiloxane was tested for comparison to a drum identical in all respects except the binder was entirely polyvinylbutyral. This showed a reduced dark decay of 15% and a lower discharge voltage of 42%.

EXAMPLE 2

A photoconductive drum like that of Example 1 was formed except that the CGL mixture contained by weight 45 parts of the Type IV oxotitanium phthalocyanine and 55 parts of a blend of the polyvinylbutyral, the poly(methylphenyl)siloxane and polyhydroxystyrene (specifically, TriQuest LP), in the weight ratio 50 parts polyvinylbutyral, 45 parts polysiloxane and 5 parts polyhydroxystyrene (50/45/5).

Polyhydroxystyrene is simply a styrene with one hydroxyl substituent addition polymerized at the ethylene substituent characteristic of styrene. Polyhydroxystyrene is a phenolic resin. Phenolic resins are known to enhance electrical properties in binder blends with polyvinylbutyral, but other effects from phenolic resins, specifically electrical fatigue, make the use of large amounts impossible. The effects can be so large that after 10,000 prints the all black page is white. This is caused by a large change in the discharge residuals.

Reduction in the amount of phenolic stabilizes the electrical performance of the resultant photoconductor, while not realizing the dark decay and discharge effects of the phenolic resin. In accordance with the invention, the phenolic resin blended with the polyvinylbutyral and the polysiloxane should be no more than 1 to 20% by weight, more preferably 2 to 10% by weight, of the total weight of the binder resins.

The drum of Example 2 was compared against an identical drum except that the binder resin was all the polyvinylbutyral, with the following results:

Dispersion stability: The electrical discharge change over 60 days was 71% lower.

Coating uniformity: The coat uniformity for the electrical discharge was improved by 50%.

Electrical performance: The discharge electrical characteristics of combined desired low discharge voltage and reduced dark decay was improved by 30%. Increasing the polysiloxane percent and lowering the polyhydroxystyrene percent enhances these discharge electrical characteristics.

The optimum formulation for all effects, particularly dispersion stability, was found to be the 50/45/5 of Example 2.

EXAMPLE 3

Drums identical to those of Example 2 were made except that the binder blend was in a ratio by weight of 50 parts polyvinylbutyral, 47 parts polysiloxane, and 3 parts polyhydroxystyrene and the charge transport layer contained 30% by weight TPD and 70% by weight polycarbonate A (MAKROLON-5208). Also, drums were made with varying pigment concentrations of 35, 45 and 55 percent by weight of the total weight of the CGL. These were compared against an otherwise identical drum having by weight 45 percent pigment and 55 percent polyvinylbutyral with the following results.

Initial electrostatics (initial sensitivity to discharge light): The initial electrostatics were improved by 10% for the 35% dispersion, 20% for the 45% dispersion, and 27% for the 55% dispersion.

Cycling fatigue: The change in the dark decay over 1000 electrical cycles was improved by 10% for the 35% dispersion, 36% for the 45% dispersion and 25% for the 55% dispersion.

EXAMPLE 4

Example 3 was repeated except that the CTL was 40 percent by weight p-diethylaminobenzaldehyde (diphenylhydrazone) (DEH) in the polycarbonate, with the following results.

Initial electrostatics (initial sensitivity to discharge light): The initial electrostatic discharges were reduced by 16% for the 35% dispersion, 24% for the 45% dispersion and 30% for the 55% dispersion.

Cycling fatigue: No measurable difference was seen between the samples for cycling fatigue.

Varying the amount of pigment between 35 to 45 parts as in Examples 3 and 4 showed little change in properties. However, it does permit the final product to be designed to selected characteristics within a limited range.

EXAMPLE 5

Drums were made identical to Example 3 except one had 45 parts by weight pigment of the total CGL weight and a binder ratio of 50, 45, and 5 (50/45/5) parts by weight of the polyvinylbutyral, polysiloxane and polyhydroxystyrene, respectively; one had the 45 parts by weight pigment and a binder ratio being 86, 7 and 7 (86/7/7) of polyvinylbutyral, polysiloxane and polyhydroxystyrene, respectively; one had 55 parts by weight pigment of the total CGL weight and a binder ratio of 50, 45, and 5 (50/45/5) parts by weight of polyvinylbutyral, polysiloxane and polyhydroxystyrene, respectively; and one had the 55 parts by weight pigment of the total CGL weight and various binder ratios of 86, 7, and 7 (86/7/7); 90, 3, and 7 (90/3/7); and 92, 1, and 7 (92/1/7) parts by weight of polyvinylbutyral, polysiloxane and polyhydroxystyrene, respectively.

Based on the fatigue results of these drums, the performances of photoconductors containing either the 50/45/5, 86/7/7, 90/3/7, or 92/1/7 ratio are very similar. All drums exhibited similar coating quality.

BINDERS BLENDS REMAIN A MIXTURE

Binders in accordance with the foregoing blends have been studied for chemical reaction. Molecular weights were measured for a solution containing the three polymer binder and compared to a thin-film cast from the solution and dried at 100C/20 minutes. The molecular weights were determined by Get Permeation Chromatography (GPC) using a polystyrene standard. The glass transition temperature was also determined. No significant difference in the molecular weights of the solution and the film appeared. All GPC chromatograms had bimodal and trimodal distribution.

Also, any crosslinking reaction should be accompanied by change in the glass transition temperature (Tg). The Tg of the film sample is similar to that of the polyvinylbutyral, indication that no reaction has occurred.

Also, infra-red transmission spectrums of the blend solution and the film were compared. No perceptible difference owing to any chemical reaction is evident from the IR transmission spectrum. Any cross-linking chemical reaction should result in lowering the percent transmission for function groups such a hydroxy groups, and this did not appear.

Additionally, a test was carried out in which the film or the CGL was dissolved in a solvent such a tetrahydrofuran. No crosslinked or swollen materials were observed.

Based on the foregoing tests and observations, the binder mixtures are shown not to generate any new chemically cross-lined materials.

Alternative formulations based on a blend of polyvinylbutyral and polysiloxanes will be apparent from the foregoing and may be developed in the future on the basis of the foregoing.

What is claimed is:

1. A photoconductive member comprising: a conductive substrate, and a charge generation layer on said substrate comprising a thorough mixture of phthalocyanine pigment, polyvinylbutyral, a methyl or phenyl polysiloxane, and a phenolic resin, said polyvinylbutyral, said polysiloxane, and said phenolic resin being a binder for said pigment, the amount by weight of said phenolic resin being in the range of 1 to 20 percent of the total weight of said polyvinylbutyral, said polysiloxane, and said phenolic resin.

2. The photconductive member as in claim 1 in which said range by weight of said phenolic resin is 2 to 7 percent.

3. The photoconductive member as in claim 2 in which said poyvinylbutyral is about 55 parts by weight, said polysiloxane is about 45 parts by weight, and said phenolic resin is about 5 parts by weight.

4. The photoconductive member as in claim 3 in which said phenolic resin is polyhydroxystyrene.

5. The photoconductive member as in claim 4 in which said polysiloxane is selected from the group consisting of poly(methyl-phenyl)siloxane, random poly(dimethyl-diphenyl)siloxane having about the same number of dimethyl and diphenyl groups and polydimethylsiloxane.

6. The photoconductive member as in claim 5 in which said polysiloxane is in an amount of at least 1 percent by weight of the total weight of said binder.

7. The photoconductive member as in claim 6 in which said pigment is Type IV oxotitanium phthalocyanine.

8. The photoconductive member as in claim 5 in which said pigment is Type IV oxotitanium phthalocyanine.

9. The photoconductive member as in claim 5 in which said polysiloxane is poly(methyl-phenyl)siloxane.

10. The photoconductive member as in claim 4 in which said pigment is Type IV oxotitanium phthalocyanine.

11. The photoconductive member as in claim 3 in which said polysiloxane is selected from the group consisting of poly(methyl-phenyl)siloxane, random poly(dimethyl-diphenyl)siloxane having about the same number of dimethyl and diphenyl groups and polydimethylsiloxane.

12. The photoconductive member as in claim 11 in which said polysiloxane is in an amount of at least 1 percent by weight of the total weight of said binder.

13. The photoconductive member as in claim 12 in which said pigment is Type IV oxotitanium phthalocyanine.

14. The photoconductive member as in claim 11 in which said pigment is Type IV oxotitanium phthalocyanine.

15. The photoconductive member as in claim 3 in which said pigment is Type IV oxotitanium phthalocyanine.

16. The photoconductive member as in claim 2 in which said phenolic resin is polyhydroxystyrene.

17. The photoconductive member as in claim 16 in which said polysiloxane is selected from the group consisting of poly(methyl-phenyl)siloxane, random poly(dimethyl-diphenyl)siloxane having about the same number of dimethyl and diphenyl groups and polydimethylsiloxane.

18. The photoconductive member as in claim 17 in which said polysiloxane is in an amount of at least 1 percent by weight of the total weight of said binder.

19. The photoconductive member as in claim 18 in which said pigment is Type IV oxotitanium phthalocyanine.

20. The photoconductive member as in claim 18 in which said polysiloxane is poly(methyl-phenyl)siloxane.

21. The photoconductive member as in claim 17 in which said pigment is Type IV oxotitanium phthalocyanine.

22. The photoconductive member as in claim 16 in which said pigment is Type IV oxotitanium phthalocyanine.

23. The photoconductive member as in claim 2 in which said polysiloxane is selected from the group consisting of poly(methyl-phenyl)siloxane, random poly(dimethyl-diphenyl)siloxane having about the same number of dimethyl and diphenyl groups and polydimethylsiloxane.

24. The photoconductive member as in claim 23 in which said polysiloxane is in an amount of at least 1 percent by weight of the total weight of said binder.

25. The photoconductive member as in claim 24 in which said pigment is Type IV oxotitanium phthalocyanine.

26. The photoconductive member as in claim 23 in which said pigment is Type IV oxotitanium phthalocyanine.

27. The photoconductive member as in claim 2 in which said pigment is Type IV oxotitanium phthalocyanine.

28. The photoconductive member as in claim 1 in which said polysiloxane is selected from the group consisting of poly(methyl-phenyl)polysiloxane, random poly(dimethyl-diphenyl)polysiloxane having about the same number of dimethyl and diphenyl groups and polydimethylsiloxane.

29. The photoconductive member as in claim 28 in which said polysiloxane is in an amount of at least 1 percent by weight of the total weight of said binder.

30. The photoconductive member as in claim 29 in which said pigment is Type IV oxotitanium phthalocyanine.

31. The photoconductive member as in claim 28 in which said pigment is Type IV oxotitanium phthalocyanine.

32. The photoconductive member as in claim 1 in which said phenolic resin is polyhydroxystyrene.

33. The photoconductive member as in claim 32 in which said polysiloxane is selected from the group consisting of poly(methyl-phenyl)siloxane, random poly(dimethyl-diphenyl)siloxane having about the same number of dimethyl and diphenyl groups and polydimethylsiloxane.

34. The photoconductive member as in claim 33 in which said polysiloxane is in an amount of at least 1 percent by weight of the total weight of said binder.

35. The photoconductive member as in claim 34 in which said pigment is Type IV oxotitanium phthalocyanine.

36. The photoconductive member as in claim 33 is which said pigment is Type IV oxotitaniium phithalocyanine.

37. The photoconductive member as in claim 32 in which said pigment is Type IV oxotitanium phthalocyanine.

38. The photoconductive member as in claim 1 in which said pigment is Type IV oxotitanium phthalocyanine.

* * * * *